US005280754A

United States Patent [19]

Flanagan et al.

[11] Patent Number: 5,280,754

[45] Date of Patent: Jan. 25, 1994

[54] TRANSIT CAR POWER DOOR OBSTRUCTION SENSING SYSTEM AND DEVICE

[75] Inventors: Daniel J. Flanagan, Des Plaines; Robert M. Gutierrez; Patrick J. Udelhofen, both of Chicago; William J. Patsch, Oswego, all of Ill.

[73] Assignee: Mark IV Transportation Products Corp. (Vapor Div), Niles, Ill.

[21] Appl. No.: 908,645

[22] Filed: Jul. 2, 1992

Related U.S. Application Data

[63] Continuation of Ser. No. 698,419, May 10, 1991.

[51] Int. Cl.[5] ..... E05F 15/00

[52] U.S. Cl. ..... 105/341; 49/28; 49/29; 318/266; 318/468

[58] Field of Search ..... 187/57, 52 R, DIG. 1; 105/341, 339, 331, 343; 49/26, 28, 29, 473.4, 475; 318/266, 284, 285, 468, 469

[56] References Cited

U.S. PATENT DOCUMENTS

| | | | |
|---|---|---|---|
| 1,792,420 | 2/1931 | Foreman . | |
| 1,813,564 | 7/1931 | Conklin . | |
| 1,828,860 | 10/1931 | Conklin . | |
| 2,096,043 | 10/1937 | Johnson | 105/341 |
| 2,130,764 | 9/1941 | Conklin | 192/150 |
| 3,237,932 | 3/1966 | Catlett | 49/26 |
| 3,466,801 | 9/1969 | Bohn | 49/475 |
| 3,782,034 | 1/1974 | Lynn et al. | 105/341 |
| 3,828,693 | 8/1974 | Kampmann et al. | 49/475 |
| 3,857,197 | 12/1974 | Reddy et al. | 49/360 |
| 4,369,399 | 1/1983 | Lee et al. | 318/467 |
| 4,922,168 | 5/1990 | Waggamon et al. | 49/26 |
| 4,981,084 | 1/1991 | Templeton et al. | 105/341 |

*Primary Examiner*—Robert J. Oberleitner
*Assistant Examiner*—Kevin D. Rutherford
*Attorney, Agent, or Firm*—Francis J. Lidd

[57] ABSTRACT

A system for detecting objects in the path of a power operated, movable door operating in a mass transit vehicle, which would obstruct door closing. The system also includes an integral method for detection of a "free wheeling" door occasioned by failure of the door mechanical drive. Method and apparatus disclosed utilize door handle locating devices such as electrical switches located at predetermined points along the door closure track. A combination of door locations along the closure track centrally define positions signaling either door linkage failure with attendant "free wheeling" door, and/or door obstruction, in each case, the system disclosed prevents train motion until the improper door condition is remedied. The combination provides a reduction in passenger hazards occasioned by train movement with defective operator linkage and/or door obstruction due to trapped passengers or other impediments to door closure.

7 Claims, 5 Drawing Sheets

FIG. 5
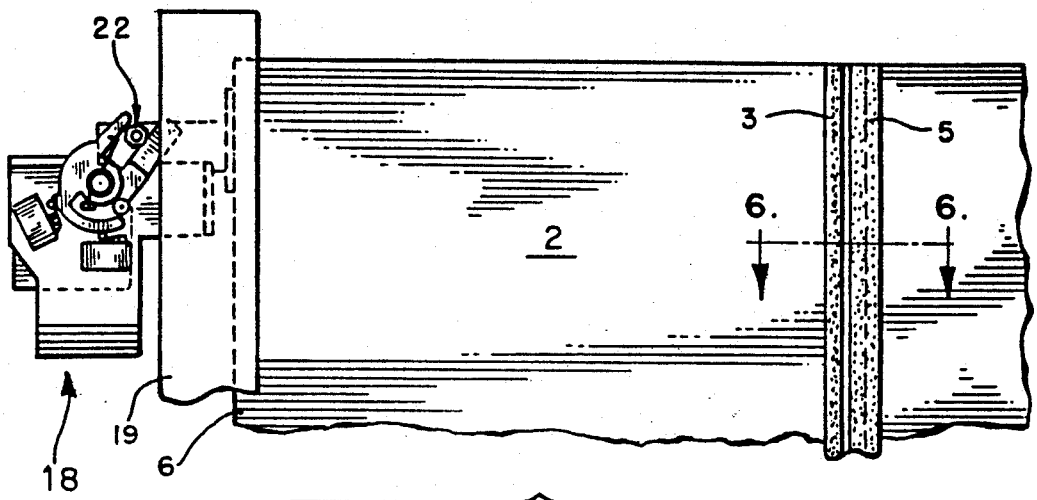
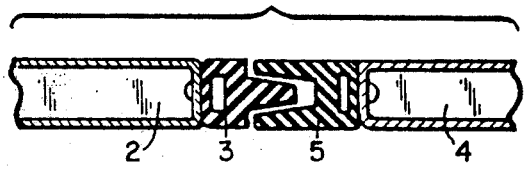
FIG. 6
FIG. 7
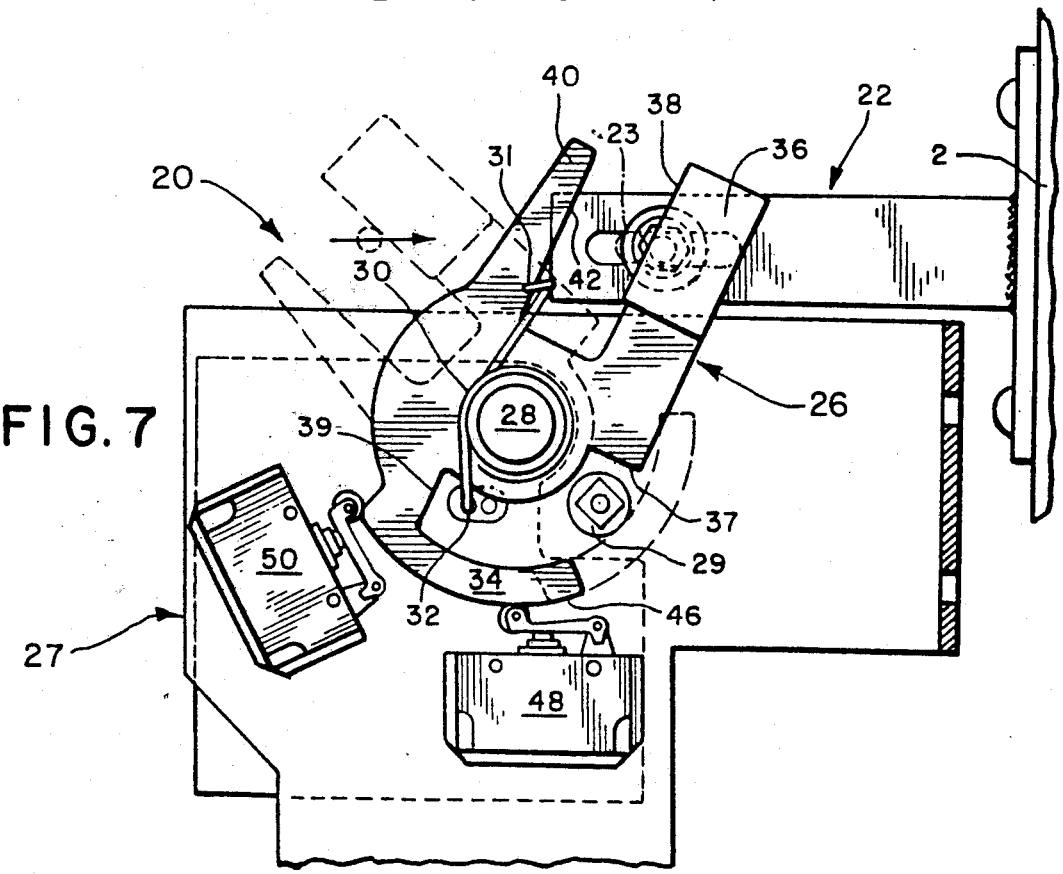

TRANSIT CAR POWER DOOR OBSTRUCTION SENSING SYSTEM AND DEVICE

This is a continuation of copending application Ser. No. 07/698,419 filed on May 10, 1991.

BACKGROUND OF THE INVENTION

This invention relates generally to improved operation of power doors on mass transit vehicles, and more particularly the detection of door malfunctions during vehicular operation either due to linkage failure or obstruction in the path of a closing door, in either case, conditions under which train movement should be inhibited.

The system and apparatus disclosed utilizes panel sensing through actuation by the moving panel of a fixed location sensor, providing an indication of door panel passage past predetermined points along the door travel path.

Panel sensing has been disclosed in U.S. Pat. No. 3,857,197, assigned to the same assignee as the instant application, said patent is herein incorporated by reference. The apparatus disclosed and claimed in U.S. Pat. No. 3,857,197 works well and is in use, however, the system does not adequately provide for detection of "small" obstructions in the path of a properly operating power door. Further, the switch actuating mechanism as disclosed does not incorporate certain features required to provide a door system capable of detecting "small" obstructions on closing the doors of a vehicle so equipped.

Applicants' discovery as disclosed herein includes improvements upon the panel sensing system described in U.S. Pat. No. 3,857,197 which essentially overcome the above mentioned difficulties in transit vehicle operation and door control.

Accordingly, it is an object of this invention to provide a power door system for use in a mass transit vehicle having a panel sensing/obstruction detection function which allows determination of improper door operation either due to malfunction of the door actuator linkage, or an obstruction in the path of vehicular door on closing.

It is an additional object of this invention to provide a door closure system including obstruction detection on door closure which allows removal of an obstruction preventing door closing without an undue increase in passenger discharge times of a given vehicle.

It is a further object of this invention to provide a power door closure system including a means for detecting malfunctioning or damaged door closure equipment, thereby preventing movement of a train having improperly operating doors.

It is yet an additional object of this invention to minimize passenger loading and unloading times through the use of a novel door panel sensing mechanism which provides an indication of car door system malfunction.

BRIEF DESCRIPTION OF THE DRAWINGS

Other objects and advantages of the invention will become apparent upon reading the following detailed description and upon reference to the drawings in which:

FIG. 5 is an additional partial internal view of the operated sliding door pair of FIG. 1, particularly showing doors in the fully closed position.

FIG. 6 is a partial section along line 6—6 of FIG. 5, particularly showing the door leaf edges in a fully closed position.

FIG. 7 is a composite semi-diagrammatic view of a right hand version of the switch actuator disclosed in this application, shown in relationship to the door actuating pin and actuator cam in the closed position including an additional location of the switch actuator cam of the invention as it would be positioned in the door open position.

While the door obstruction sensing system of the invention will be disclosed in connection with a preferred embodiment, it will be understood that it is not intended to limit the application of door obstruction and free-wheeling door detection to that embodiment. On the contrary, the invention disclosed herein is intended to cover all alternatives, modifications and equivalents as may be included within the spirit and scope of the invention disclosed as defined by the appended claims.

DETAILED DESCRIPTION OF THE INVENTION

Figures 3, 4:
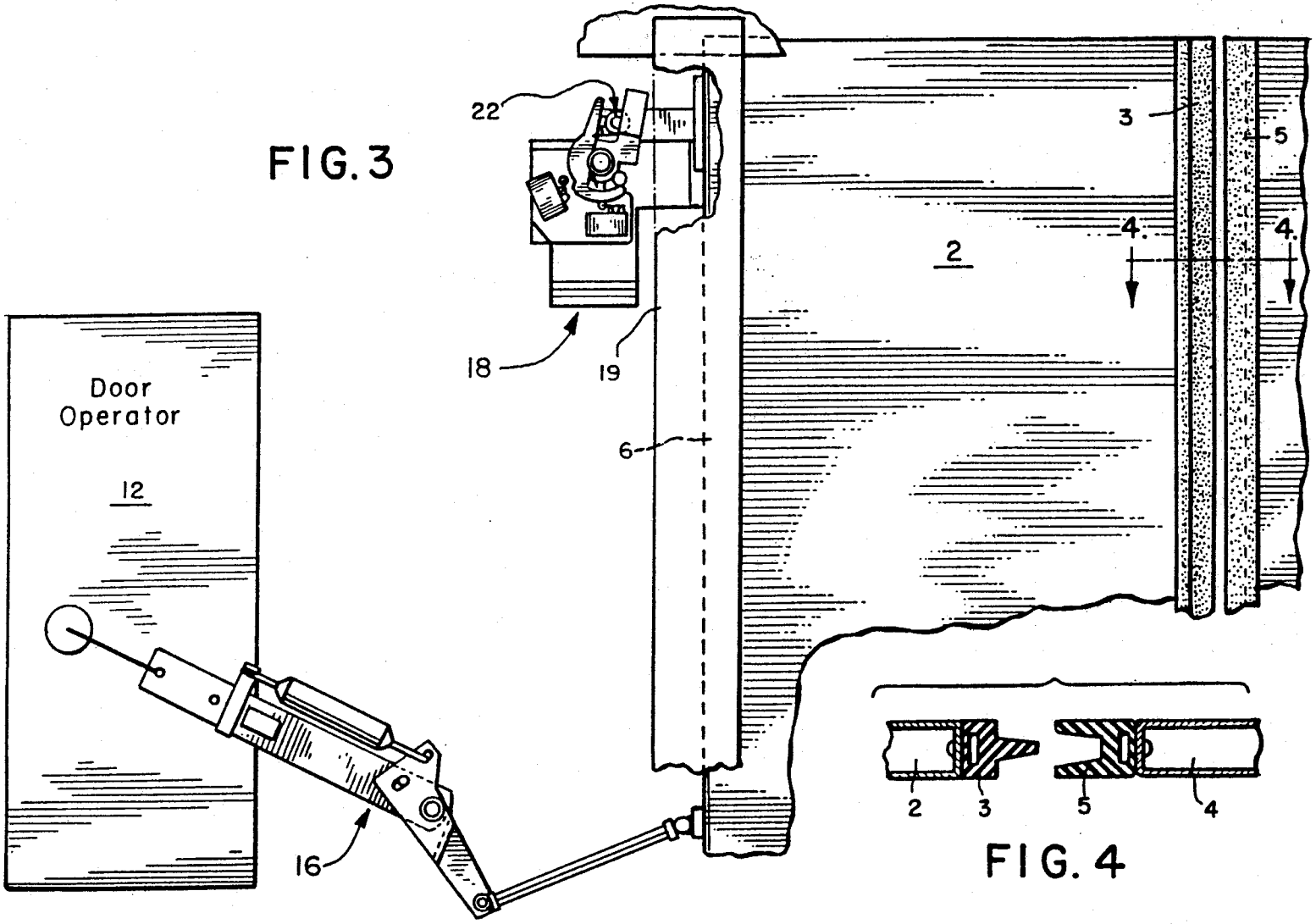
FIG. 3 is an additional partial internal view of a transit car power operated sliding door pair as shown in FIG. 1, particularly showing doors in an almost-closed, obstruction-sensing position.
FIG. 4 is a partial section along the line 4—4 of FIG. 3, particularly showing the edges of the door leafs of FIG. 1 in the obstruction sensing position.

Turning now to FIGS. 1 through 5, there is shown a power door system for use in transit vehicles having a left-hand door leaf assembly 2 and a right hand door leaf assembly 4. Doors 2 and 4 are mounted in a transit car door opening in a car side wall (not shown). Doors 2 and 4 are mounted on the car structure such that reciprocal and opposite motion is achieved through force applied to the trailing door edges 6 and 8 by right hand actuator assembly 10 and left hand actuator assembly 12, through right hand operating assembly 14 and left hand operating assembly 16. A more complete description of the function of said operators 10 and 12 is contained in U.S. Pat. No. 3,857,197 incorporated by reference hereinabove. Door assemblies 2 and 4 are equipped with resilient leading edges 3 and 5 designed to provide a reasonable air seal and further, as will be described hereinafter, to allow withdrawal of obstructions when doors 2 and 4 approach complete closure as shown in FIGS. 3 and 4.

Attached to the car body structure at 19 and 21, and adjacent to said moving door panels, are companion switch actuating assemblies 18 and 20, respectively. Also attached to the trailing edges 6 and 8 of doors 2 and 4 are switch actuating pins 22 and 24, respectively. Pins 22 and 24 co-act with the switch actuator assemblies 18 and 20 to detect door motion, as will be described in more detail below.

Figure 1:
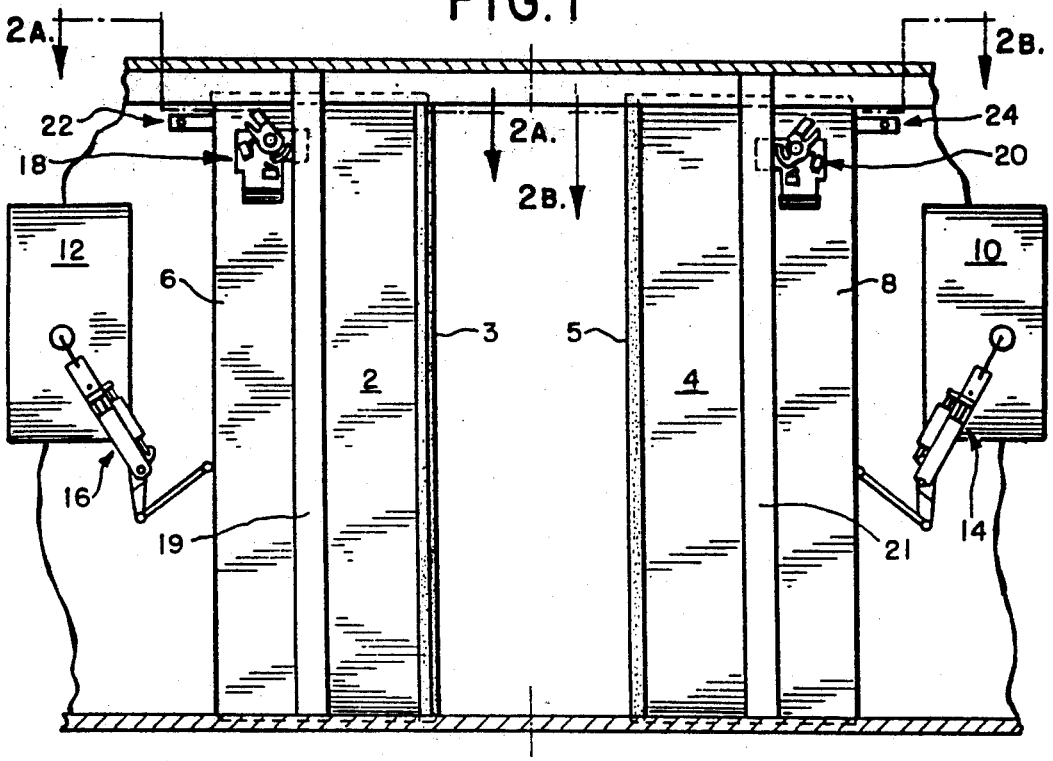
FIG. 1 is a partial internal, semi-pictorial view of a transit car showing a power operated sliding door pair, with door leafs in a partially open position, and particularly showing the switch actuator of the invention in de-actuated state.
Figure 2A:
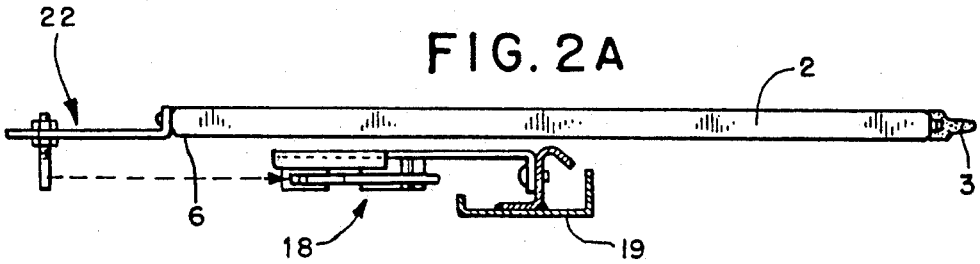
FIG. 2A is a partial top view of FIG. 1 showing one leaf of the door pair of FIG. 1 and associated switch actuator.
Figure 2B:
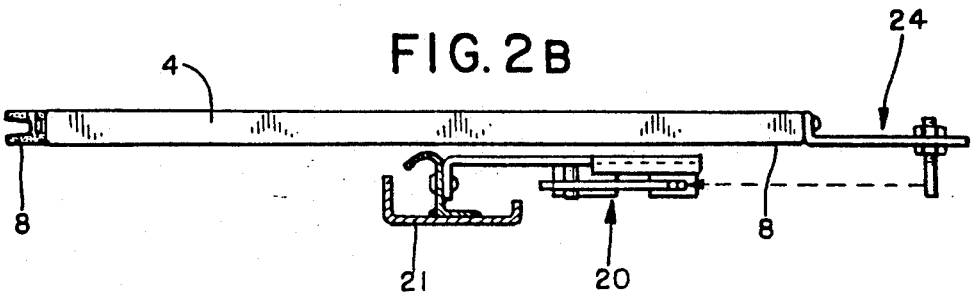
FIG. 2B is a partial top view of the door leaf opposite to the leaf of FIG. 2A and associated switch actuator.

In operation, door leafs 2 and 4 driven by actuators 12 and 10 through operating assemblies 16 and 14, respectively, reciprocate in motion opposite the other to open and close a car door opening (not shown). In FIG. 1, a door position intermediate open and closed is shown with no operation of actuators 18 and 20 by pins 22 and 24.

In FIG. 3, the door leaf position has moved toward a closed position wherein actuators 18 and 20 (not shown) are partially operated by the actuating pins 22 and 24.

In FIG. 5, the door leafs are shown in a fully closed position wherein the switch actuators 18 and 20 (not shown) are fully actuated. The significance of switch actuation will be developed in greater detail hereinafter.

Turning now to FIG. 7, an enlarged view of the left hand switch actuator 20 is shown in detail, and in operating relationship to the actuator pin assembly 22, with the right hand door leaf in the fully closed position.

In further reference to FIG. 7, the switch actuating assembly 18 consists of a mounting plate 27 affixed to a portion of the car body 21 (reference FIG. 1). Somewhat centrally located on the mounting plate is a switch cam pivot or shaft 28, having the switch cam assembly 26 mounted for rotary motion therearound. A finger-like switch cam lobe 34 extends circumferentially from stop cam surface 39, ending intermediate of the surface 37. The inner surface of lobe 34 and surfaces 37 and 39 define an arc-like travel limit groove or guide for cam stop 29. Switch cam stop 29 projects outwardly from the surface of the mounting plate of assembly 27 into the above-mentioned travel limit groove so as to contact portions of the rotating cam assembly 26, at stop surfaces 37 and 39, thereby limiting circular motion around the shaft 28.

Also mounted on the cam shaft 28 is a torsion spring 30 having one end 32 affixed to the mounting plate 27 with the opposite end 31 in pre-loaded contact with the surface 42 of the cam actuator secondary arm 40. The torsion spring 30 operates to maintain a positive clockwise torque on the cam assembly 26 so as at all times to maintain contact between pin contact surface 38 and the actuating pin 23 when pin 24 is in operating cooperation with the cam 26. If, however, spring 30 should fail, the design of cam assembly 26 is such that gravity will cause its position after actuation by pin 24, in either direction, to be retained, resulting in continued proper operation of switches 48 and 50.

Also attached to the mounting plate assembly 27 is free-wheeling door switch 48, and obstruction sensing switch 50 mounted so as to co-act with the switch operating cam surface 46 of cam lobe 34 for operating said switches from open to closed contact configurations through movement of pin 23 for predetermined positions of the door leaf 4 as represented by the location of pin 23. The substantial significance of the particular door positions resulting in actuation or de-actuation of switches 48 and 50 will be discussed in substantial detail below. Extending in a somewhat parallel manner from the cam assembly 26 are the fork-like projections 36 and 40. Projections 36 and 40 define an internal actuating pin contact surface 38 and an auxiliary or secondary pin contact surface 42. Adjacent to the arm 36 is an arc-like portion of the cam assembly 26 defining stop surfaces 37 and 39. These surfaces co-act with stop 29 to limit rotation of the cam assembly 26 as discussed above. An additional portion of the cam assembly 26 is a switch actuating sector 34, having an operating surface 46 for depressing the operating lever of switches 48 and 50.

In operation, with reference to FIGS. 1, 3 and 5, three door positions as shown, the actuating assembly 20 provides electrical contact closures and non-closures for various door positions, which have been found to be vital in transit vehicle operation. In particular, as shown in FIG. 1, for a door position either fully open or partially open, since the pin 23 is remote from the actuating surface 38 of switch actuating cam assembly 26, cam assembly 26 is as shown in FIG. 1 and the phantom location of FIG. 7 having both free-wheeling switch (FWDS) 48 and the obstruction sensing switch (OSS) 50 de-actuated, the normally closed and normally open contact configurations of these switches are, therefore, both in a normally open state.

With reference to FIG. 3, wherein the door leaf 4 is shown in a position somewhat less than 2.75" from fully closed, the FWDS switch 48 is in an actuated position, thereby transferring the normally open and normally closed contact positions to a normally closed state. Under these conditions, the electrical signal indicating the location of the door in this position with respect to fully closed is provided indicating door movement from fully open. An indication that the door is not in the fully closed position is also provided by non-operation of the OSS switch 50.

Turning now to FIGS. 5 and 6, where the door leaf location with respect to fully closed is less than 2.75" and also less than a significant dimension 0.31", both the FWDS and OSS switches are actuated, providing electrical signals indicating a fully closed door leaf. Under these conditions, as will be discussed further, signals from switches 48 and 50 provide indications of door closure. The significance of this will be further explained.

Figure 9:
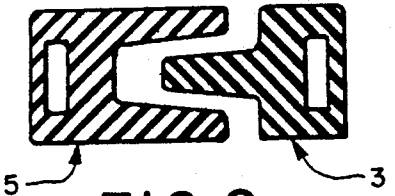
FIG. 9 is a further cross-sectional view of the edges of FIG. 8, particularly showing the door leaf edges prior to door closing.
Figure 10:
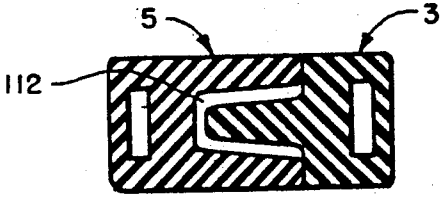
FIG. 10 is a further cross-sectional view of the novel door edges of the invention, with the doors in a fully closed position.
Figure 8:
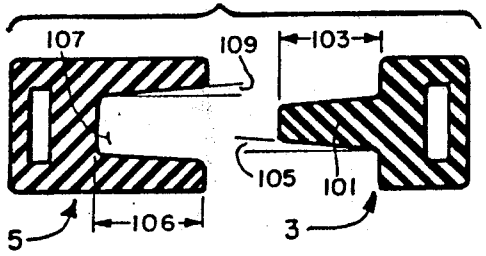
FIG. 8 is a cross-sectional view of the door edges of the doors shown in FIGS. 1 through 6, particularly with the doors in a partially open position associated with the operation of the free-wheeling door switch.

In keeping with the invention disclosed herein, door edges 3 and 5 provide a major component of the obstruction sensing system described herein. With particular reference to FIGS. 3, 4, 8, 9 and 10, there is shown the cooperating configurations of edges 3 and 5 for door positions corresponding to the switch actuating positions of the actuator assemblies 18 and 20, as discussed above. In particular, FIG. 8 shows the door position of FIG. 1, wherein OSS 50 and FWDS 48 are de-actuated. In FIGS. 4 and 9, the edge configuration corresponds to the door leaf location of FIG. 3, wherein FWDS switch 48 is actuated and OSS 50 is essentially not actuated. FIGS. 6 and 10 essentially correspond to the door leaf position of FIG. 5 wherein both FWDS switch 48 and OSS switch 50 are actuated, indicating complete door closure.

With regard to obstruction sensing on door leaf closure, as discussed above, it has been discovered that in the obstruction sensing position, wherein the door leafs are with respect to fully closed, less than 2.75" from closure, but greater than 0.31" from closure, typically as shown in FIG. 3, 4 and 9, many obstructions to door closing, such as caused by passenger clothing, passenger hands, handbags and other undescribed material, often caught in partially closed doors, preventing full door closure and, due to non-actuation of OSS 50, prevent car movement, as will be described later. The particular configuration shown and material used have been chosen to provide reasonable ease of obstruction withdrawal consistent with limiting nuisance delays in car operation. In addition, the door edge design reduces edge-to-edge abrasive contact during door operation. Therefore, this door edge configuration, in conjunction with switch assemblies 18 and 20, provides a novel and substantial advance in the art of transit car operation in that transit car delays during loading and unloading are reduced due to ease of obstruction withdrawal, and possible injury to passengers is minimized, since the above-mentioned OSS switch 50 prevents train movement until a substantial obstruction is withdrawn.

It has also been discovered that a particular cross sectional configuration of interlocking edges 3 and 5 is particularly effective in door obstruction sensing for door locations associated with operation and/or non-operation of OSS switch 50. With reference to FIG. 8, typically the edge configuration of the invention utilizes operating vertically lengthwise edges 3 and 4. As shown, edge 3 includes a tongue-like projection 101 having an operative or effective length 103 and a base to leading edge taper 105. Cooperating edge 5 includes a cavity or recess 107 having an operative or effective depth 106 and an edge to cavity bottom taper 109. With particular reference to FIG. 10, wherein doors 2 and 4 are shown fully closed, tongue 101 and cavity 107 define an interstice 112. It has been discovered that this interstice is of substantial importance in increasing the life of edges 3 and 5 in transit car operation.

In addition, the configuration of edges 3 and 5 as disclosed provide increased reliability of car transit operation since any operative interference between tongue 101 and cavity 107 can result in nuisance stops of the transit vehicle involved due to non-actuation or delayed actuation of OSS switch 50 during the door closing operation.

In a typical, but not limiting, configuration, cooperation edge designs would include the following nominal dimensions:

Length 103—0.750 inches
Taper 105—8 degrees
Depth 106—0.843 inches
Taper 109—8 degrees
Edge Resilience Durometer −75.

Figure 11:
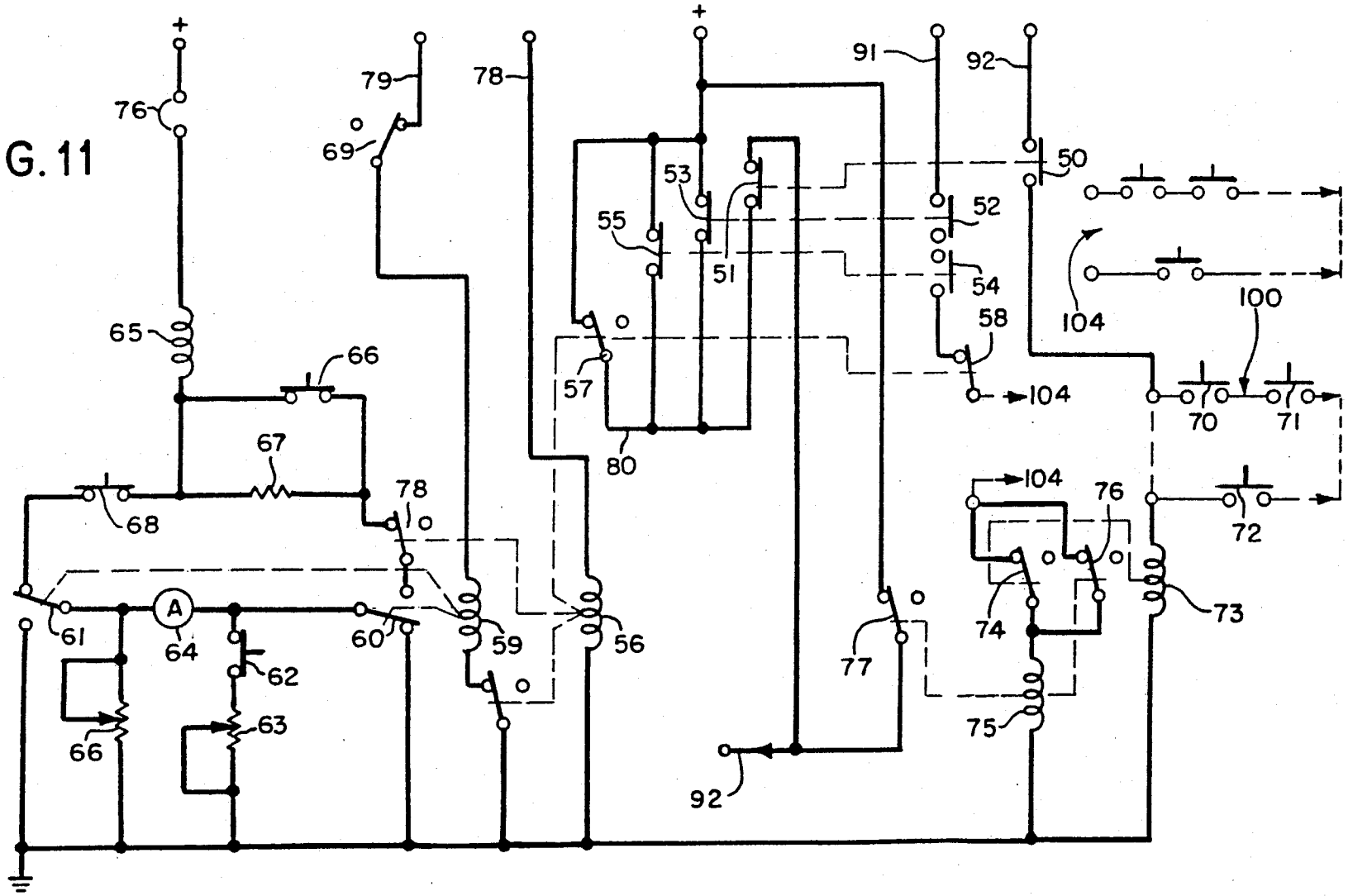
FIG. 11 is a schematic diagram showing the electric drive circuitry for a single leaf of the door system shown in FIGS. 1 through 5, particularly showing the electrical functions of the free-wheeling door switch and obstruction sensing switch of the invention disclosed herein.

With particular reference to FIG. 11 showing the operational circuitry of the door system utilizing the invention, although in a typical installation multiple door operators are utilized in each car since each operator in its relationship to the invention disclosed herein is similar, the following description will be confined to a single door operator with some reference to associated operators in the same car and controls common to all cars in a particular train configuration. Turning again to FIG. 11, there is shown a drive motor armature 64 utilized by operators 14 and 16, and its associated series field 65 in more or less typical forward and reverse drive motor circuitry. Power is introduced through circuit breaker 76. A series dropping resistor 67 limits current to the motor field 65. Limit switch 66 (LS2) opens when door leafs are fully open, reducing motor current while doors are open. Limit switch 62 (LS3) shunts armature 64 for a portion of door motion from closed to open, reducing door speed during the final portion of door opening movement. When the door is powered in the closing direction, field current through the field 65 enters the armature 64 through limit switch (LS1) 68 and contacts 61 of relay 59. Limit switch 68 actuates internally of the operator 12 (or 10) to stop motor current when the door leaf is fully closed. Armature current returns to the supply negative via contacts 60 of relay 59. A closing speed adjustment is incorporated through the use of resistor 66 essentially shunting armature 64, thereby diverting current and controlling operator speed on closing. The supply of current to the field and armature as described above initiates door movement in the closing direction.

Figure 12:
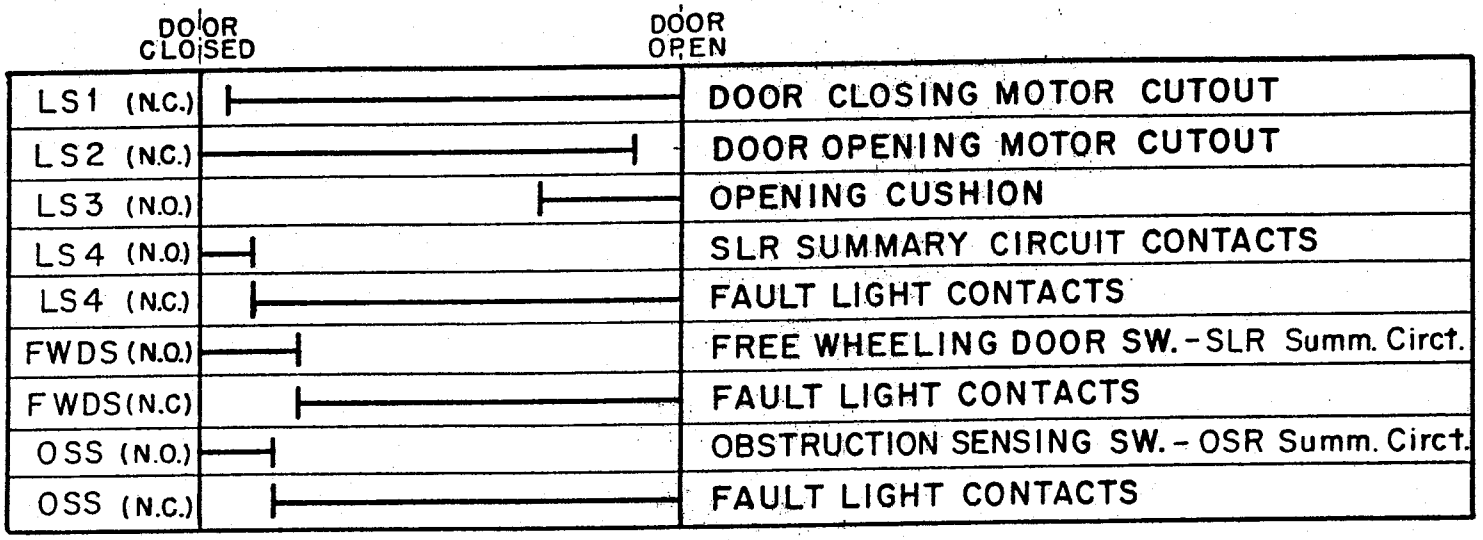
FIG. 12 is a switch actuation diagram of the door control system of the invention showing in relation to the door position actuation and de-actuation of the door control switches shown in the circuitry of FIG. 11. In particular, relative positional differences or door motion distances between operation of the free-wheeling door switch and obstruction sensing switch in conjunction with door operation of the prior art system is shown.

In additional reference to FIG. 12, as the door proceeds in the closed direction, FWDS switch 48 and OSS switch 50, along with their associated contacts remain in the unactuated position, thereby, with reference to FIG. 11, OSS switch contact 50 is open, and OSS contact 51 is closed, thereby energizing a local fault light (not shown). Obstruction sensing relay (OSR) 73 is at this point de-energized. Similarly, FWDS switch contact 52 is open, whereas, FWDS switch contact 53 is closed, providing an additional local fault light circuit. Also in the circuit of FWDS switch 52 is limit switch (LS4) contact 54 located internally of either operator 10 or 12, closed only with the arm 14 or 16 of operators 10 or 12, in their fully closed position; now, however, as the door is not fully closed, contact 54 is open, thereby de-energizing SLR relay 75. Contact 74 of the OSR 73 also interrupts current from SLR relay 75, as it is now in its de-energized position. Absence of both door unlock signal along line 78 and door open signal on line 79 de-energizes MCR relay 59 and LR contactor 56. LR relay 56 contact 58 moves to its shown position thereby establishing a circuit between FWDS 52, limit switch LS4 contact 54, and summary circuit 104. The importance of the summary circuit will be discussed subsequently in more detail.

As the door proceeds in motion to the fully closed position, at the point of door position shown in FIG. 1, since neither FWDS switch 52 or OSS switch 50 have been actuated, and since LS4 actuation requires that a door operator be fully closed, all local fault lights are energized through the circuit 80. Guard lights, not a part of the invention disclosed herein, provide an exterior indication of any door not fully closed and are normally mounted inside and outside a given transit car.

When the door has proceeded to the position shown in FIG. 3, the FWDS switch 52 has been actuated, thereby opening contact 53 and removing this particular input to the local door fault light circuit. In the free-wheeling door circuit 91, since limit switch LS4 contact 54 requires the door operator to be closed and locked, its contacts remain open, thereby maintaining the Signal Light Relay (SLR) 75 in its de-energized position. Note that in the de-energized position of SLR relay 75, SLR contact 77 would be closed, thereby applying voltage to guard light circuit 92, providing an indication that at least one door on that car is not fully closed and locked.

As the door continues movement to the position shown in FIG. 5, i.e. fully closed and locked, both OSS contact 50 and FWDS contact 52 are closed. Closing of contact 50 and summary circuit 100, energizes obstruction sensing relay (OSR) 73, thereby energizing the coil of SLR relay 75 through OSR contact 74. Energizing the SLR relay 75 allows the traction interlock circuits (not shown) to be energized, which would then allow movement of the train, thereby removing power from the car guard lights indicating that all doors are properly closed. Summary circuits 100 and 104 include similar FWDS switches 70, 71 and 72, OSS switches 93, 94 and 95 in other similar operators on the same car. In operation, all doors would need to be closed in identical FWDS and OSS sequence to allow the car to move.

After all obstructions have been cleared, and all doors have been properly closed and locked, the OSS switch contacts become effectively bypassed, when SLR contacts 76 close, thereby shunting OSR contacts 74. The purpose of this bypass is to prevent nuisance interruptions of the traction interlock circuits, which could be caused by de-actuation of any OSS switch in other than a door opening situation. Such de-actuation could be caused by slight movements of the door panel either by passenger tampering or by rapid acceleration or deceleration of the train.

The importance of inclusion of the FWDS switch 52 in conjunction with OSS switch 50 in detecting obstructions, allowing obstruction removal, in order to minimize possible injury to passengers and reduce delay time due to door obstructions is as follows:

If, after all doors have closed and locked, and the OSS contacts are effectively bypassed as stated above, then a door which opens by virtue of failed drive linkage, beyond approximately the 2.75" location from fully closed, would cause de-actuation of the FWDS switch, thereby opening FWDS contact 52 in summary circuit 91. This would de-energize SLR relay 75, which would de-energize the traction interlock circuits (not shown) which, on a typical transit system, would prevent movement of the train. In this situation, SLR contact 77 would illuminate the guard lights on that car, to indicate that at least one door is not fully closed and locked, and FWDS contact 53 would illuminate the local door fault light to indicate that door is not fully closed.

Assuming the door linkage is operating properly with the FWDS closed, the door would proceed to a door position between 2.75" and 0.31" from full closure, at which point, OSS switch 50 would continue to be in a de-actuated position with the door summary circuit 92 maintained open. At this point, given the door edge design shown in FIGS. 8, 9 and 10, door edges would be in a position between that shown in FIGS. 3 and 4. Under these conditions, applicants have discovered that with car movement inhibited, a substantial number of objects can be withdrawn from the particular edge spacing and configuration after which door closure proceeds closing OSS contact 50 and its associated summary circuit, thereby allowing car movement to proceed.

Therefore, using the combination of FWDS 52, OSS switch 50 and its associated circuitry and critical door spacing provides a substantial advance in the art of obstruction sensing in the path of closing doors and early detection of door equipment malfunction.

What is claimed as new and desired to be secured by Letters Patent of the United States is:

1. In a vehicle having integral tractive power and power operated doors, a system for detecting an uncontrolled door and providing selective removal of an obstruction encountered in the path of a power operated vehicular door, in travel from open to closed positions, the improvement comprising:

an opening in a vehicle side wall, said opening having essentially parallel, vertical edges;

a door panel mounted on said side wall for travel across said opening;

means for driving said panel, said driving means moving said door in travel from open to closed and closed to open positions across said opening;

means in said driving means for locking said door on reaching said door closed position;

a first leading edge on said panel, said panel edge traversing said opening for door travel from open to closed, and closed to open positions;

a second and adjacent edge on said side wall cooperating with said first panel edge for sealing said opening when said panel is in a closed position;

a switch actuator on said car side wall and operated by said door for closing door travel to a first door position, said first door position intermediate said door open and door closed positions, said first door position and said edges defining an obstruction withdrawal spacing between said first and second edges, said spacing selectively allowing withdrawal of semi-rigid obstructions prior to said door movement to a door closed and locked position;

a first switch operated by said actuator for closing door travel, said switch having a first operational state during said door closing travel to said first door position, and a second operational state for said travel from said first door position to said closed position, said first switch first state generating a door obstruction signal;

a second door position intermediate door open and first door position;

a second switch on said switch actuator operable by said door on reaching said second position during said door travel from open to closed, said switch having a first operational state during said door closing travel from said door open position to said second door position, and a second operational state for door travel from said second door position to said door closed position, said second switch first state generating a freewheeling door signal;

means in said drive means responsive to said obstruction and free wheeling door signals to inhibit said vehicle traction power;

thereby preventing vehicle motion and actuation of said lock until said obstruction is removed.

2. The improvement of claim 1 wherein said cooperating edges further comprise:

a resilient first edge having a first portion abutting said door and a leading or operating tongued edge; and a resilient second adjacent edge having a cavity, said first edge and second edge co-acting for door positions within said obstruction withdrawal spacing to allow removal of an obstruction.

3. The improvement of claim 3 wherein said first and second edges further comprise resilient material having a durometer of 75.; and operating edge includes a tongued extension having an effective length of 0.75 inches, and has a narrowing 8 degree base-to-edge taper; and a cavity in said second edge, a base in said cavity, said cavity having an effective depth of 0.843 inches, and a widening 8 degree base-to-edge taper; and an interstice defined by said tongued extension and cavity for a door closed position.

4. Improvement of claim 1 further comprising:

an actuating pin on said panel trailing edge, said pin movable with door open and door closed positions; and, said switch actuator further comprising;

a switch operating member having forked projections and diametrically opposed switch cam means, said member rotatably mounted on said car side wall; and, a first projection on said member having one weighted end and a first distal stop surface;

a second projection on said member having a distal switch operating end, said end defining a second stop surface, and a switch cam extending circumferentially therefrom;

a pin actuating slot defined by said projections having internal pin contact surfaces, said surfaces and actuating pin cooperating to rotate said member for door motion from open to closed;

an stop on said side wall, said stop cooperating with said stop surfaces to limit member rotation during rotation from door open to door closed; and, lever means on said first and second switches for transferring said switches from said first to second operational states on contact with said switch cam during said switch operating member rotation.

5. In an obstruction sensing system for power operated vehicular doors of the type having means for driving a sliding door through an intermediate mechanical linkage, said system responsive to door position for preventing vehicle movement for predetermined door locations, the improvement comprising:

an opening in a car side wall;

at least one door panel mounted for reciprocal motion, thereby covering and uncovering said opening;

a power operator having a control system for enabling vehicular movement subsequent to generation of first, second and third signals;

linkage means intermediate said operator and door panel for moving said panel to cover and uncover said car side wall opening, said covering and uncovering corresponding to open and closed positions of said side wall openings;

a first switch in said operator control system operable by said operator for generating a first signal when said door is in a closed and locked position; and a switch actuator on said car side wall, said actuator, operable by said panel for generating signals indicative of panel positions during said closed door motion from an open position to a position adjacent to said closed and locked position;

a second switch in said control system operable by said actuator, said second switch generating a second signal for a first door position intermediate said door panel open and door panel closed and locked position;

a third switch in said control system operable by said actuator, said switch generating a third signal for a second door position intermediate said door open and first door panel positions;

means whereby vehicle motion is inhibited for predetermined door positions.

6. Improvement of claim 5 wherein said actuator further comprises:

a cam having a forked projections and diametrically opposed switch cam means, said cam rotatably mounted on said car side wall;

a first projection on said actuator having one weighted end and a first distal stop surface;

a second projection on said actuator having a distal switch operating end, said end defining a second stop surface, and a cam lobe extending circumferentially therefrom;

cam actuating slot defined by said projections;

cam actuating means on said door, said actuating means and actuating slot cooperating to rotate said cam during door motion;

an actuator stop on said side wall, said stop cooperating with said stop surfaces to limit actuator rotation, said stop surfaces and actuator stop defining cam rotation from first to second positions corresponding to door open and door closed positions;

wherein said can lobe actuates said second and third switches corresponding to said door positions.

7. A switch actuator for use in a power operated vehicular door operating system for detecting free-wheeling doors and obstructions to door closing comprising:

a mounting plate attached to the side wall of a vehicle;

a shaft extending outwardly from said plate;

a cam rotatably mounted on said shaft for motion therearound, said cam further comprising;

a first projection on said cam having a weighted end and an opposite end defining a first stop surface;

a second and adjacent projection on said cam having an opposite end defining a second stop surface, and an arcuate projection extending circumferentially below said first and second stop surfaces, said stop surfaces and projection further defining a travel limit groove;

a switch actuating cam lobe further extending from and below said projection;

a cam stop on said plate, positioned internal of said groove, said stop co-acting with said first and second stop surfaces to limit cam rotation around said shaft;

switch means on said mounting plate actuatable by said cam lobe for predetermined cam positions within cam rotation as limited by said travel limit groove;

means on said door, co-acting with said cam projections to rotate said cam, thereby actuating said switch means for various door positions.

* * * * *